US006047617A

United States Patent [19]

Chen

[11] Patent Number: 6,047,617

[45] **Date of Patent: *Apr. 11, 2000**

[54] RATCHET TOOL

[76] Inventor: Chun Chiung Chen, No. 45, Lane 25, Kuo Chung 1st Road, Da Li City, Taichung, Taiwan

[ * ] Notice: This patent is subject to a terminal disclaimer.

[21] Appl. No.: 09/154,412

[22] Filed: Sep. 15, 1998

Related U.S. Application Data

[63] Continuation-in-part of application No. 08/879,313, Jun. 20, 1997, Pat. No. 5,884,537.

[51] Int. Cl.[7] ..... B25B 13/46

[52] U.S. Cl. ..... 81/63.1; 81/60; 81/58.4

[58] Field of Search ..... 81/59.1, 63.1, 81/58.4, 60; 192/45.1, 54.2, 44, 45

[56] References Cited

U.S. PATENT DOCUMENTS

| | | | |
|---|---|---|---|
| 3,958,469 | 5/1976 | Meese | 81/58.4 |
| 5,404,773 | 4/1995 | Norville | 81/63.1 |
| 5,685,204 | 11/1997 | Braun | 81/60 |
| 5,806,381 | 9/1998 | Lin | 81/58.4 |
| 5,878,635 | 3/1999 | Hsieh | 81/60 |
| 5,884,537 | 3/1999 | Chen | 81/58.4 |
| 5,910,196 | 6/1999 | Huang | 81/60 |

*Primary Examiner*—James G. Smith
*Assistant Examiner*—Lee Wilson

[57] ABSTRACT

A ratchet tool includes a housing having a pair of protrusions oppositely extended inward of a chamber for forming two pairs of parallel channels. A gear is rotatably received in the chamber of the housing and has a driving shaft extended outward of the housing. Two pairs of pawls are slidably engaged in the channels and biased to engage with the gear for allowing the housing to drive the gear. The gear may be selectively driven in an active direction or in a reverse direction when one pair or the other pair of the pawls are disengaged from the gear.

5 Claims, 3 Drawing Sheets

RATCHET TOOL

The present invention is a continuation-in-part of U.S. patent application Ser. No. 08/879,313, filed Jun. 20, 1997, entitled "RATCHET TOOL", now U.S. Pat. No. 5,884,537.

BACKGROUND OF THE INVENTION

1. Field of the Invention

The present invention relates to a tool, and more particularly to a ratchet tool.

2. Description of the Prior Art

Typical tool cartridges comprise a core rotatably received in a housing which includes a number of ramps for engaging with roller bearings. However, it will be difficult to machine so many ramps in the housing such that the actuation of the roller bearings on the core may not be balanced. In addition, the roller bearings may not be solidly engaged with the driving stem.

The present invention has arisen to mitigate and/or obviate the afore-described disadvantages of the conventional ratchet tools.

SUMMARY OF THE INVENTION

The primary objective of the present invention is to provide a ratchet tool which includes a housing having two pairs of parallel channels tangent to the driving stem for slidably receiving two pairs of pawls and for allowing the pawls to be solidly engaged with the driving stem.

In accordance with one aspect of the invention, there is provided a ratchet tool comprising a housing including a chamber and a pair of protrusions oppositely extended inward of the chamber of the housing for defining two pairs of parallel channels, a gear rotatably received in the chamber of the housing and including a driving shaft extended outward of the housing, two pairs of engaging members slidably engaged in the channels respectively, means for biasing the engaging members to engage with the gear and for allowing the housing to drive and to rotate the gear in an active direction, and means for selectively disengaging the engaging members from the gear to allow the housing to be rotated relative to the gear in a reverse direction.

The engaging members are preferably pawls.

The selectively moving means includes a cover rotatably secured to the housing, the cover includes two poles extended into the chamber of the housing and located between the pawls for moving the pawls inward of the channels against the biasing means when the cover is rotated relative to the housing. A positioning device is further provided for positioning the cover to the housing and includes three depressions formed in the housing, and includes a spring biased projection provided in the cover for engaging with the depressions of the housing and for positioning the cover relative to the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
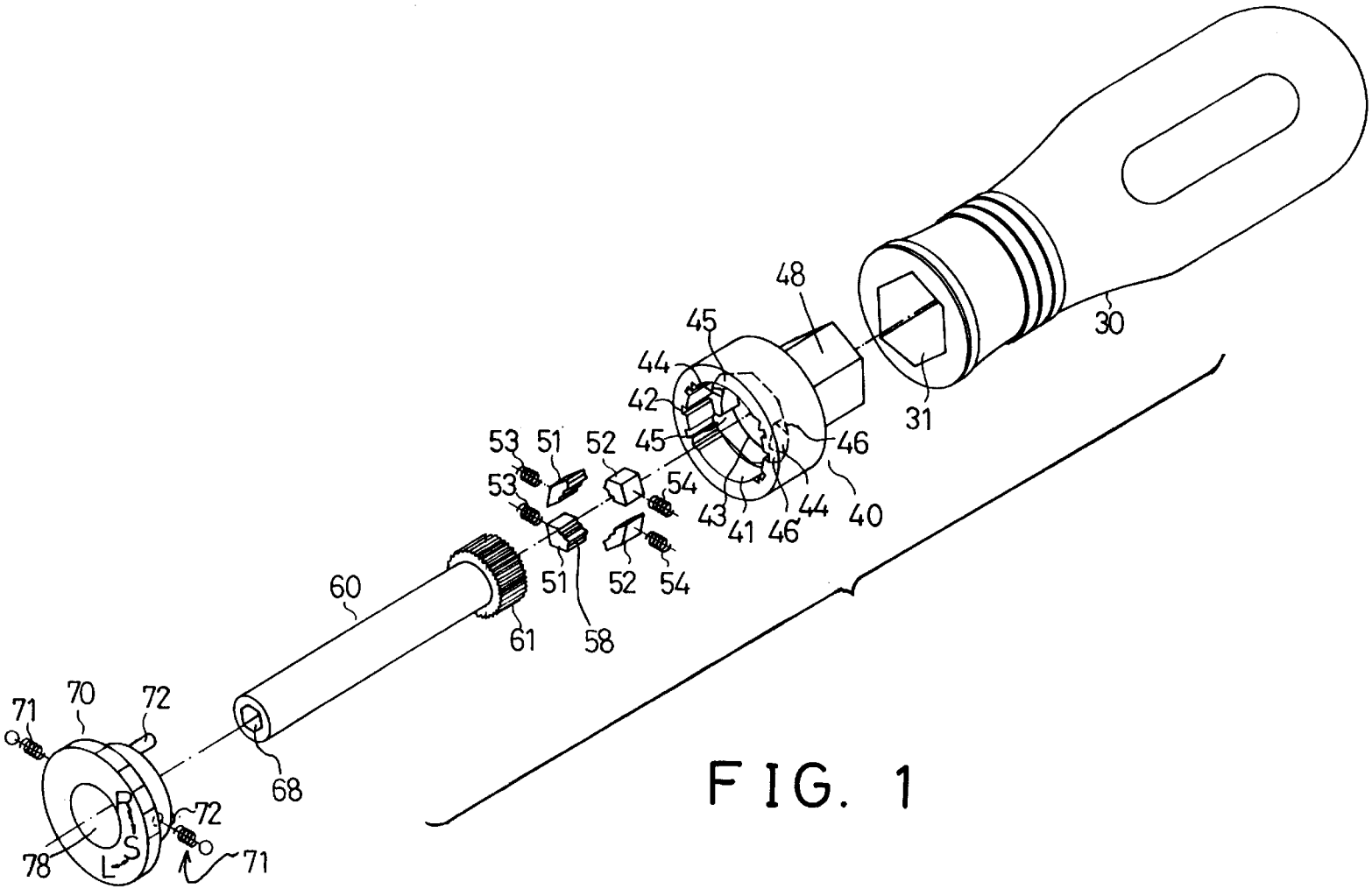
FIG. 1 is an exploded view of a ratchet tool in accordance with the present invention.
Figure 2:
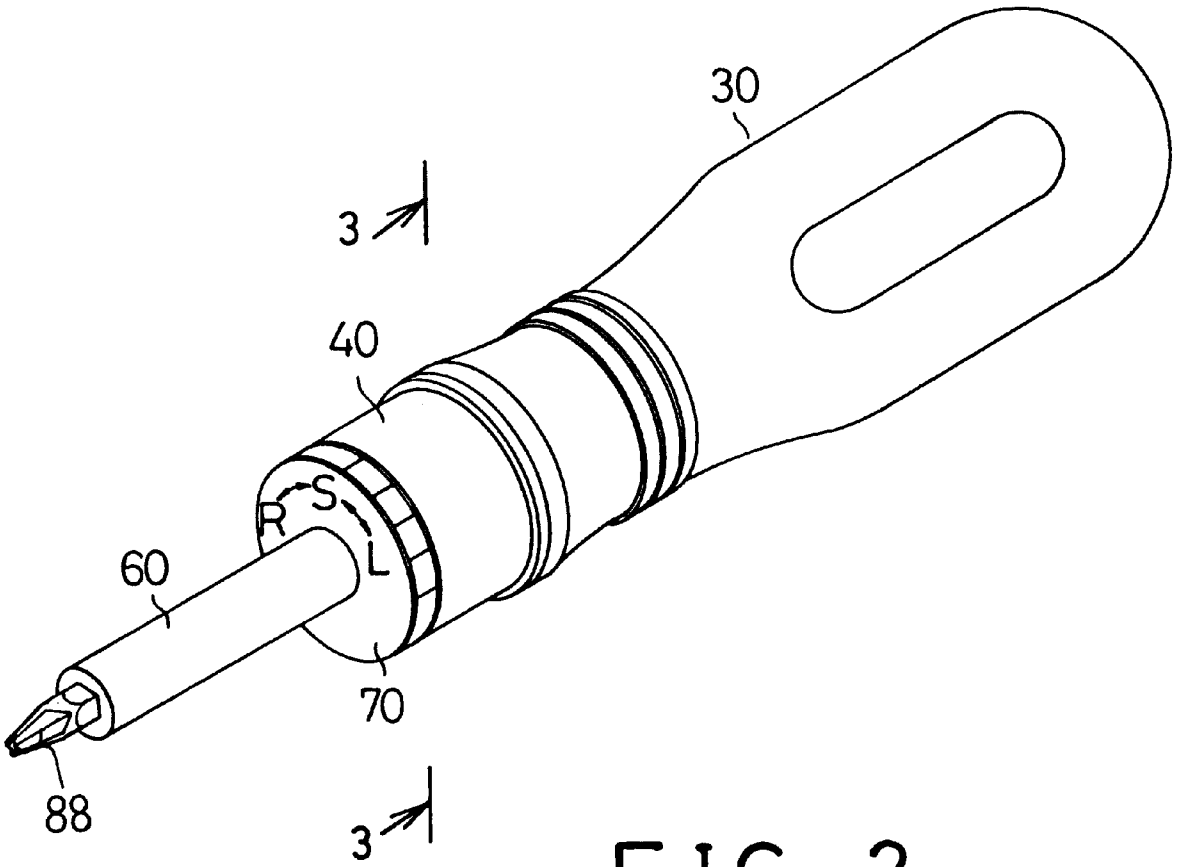
FIG. 2 is a perspective view of the ratchet tool.
Figure 3:
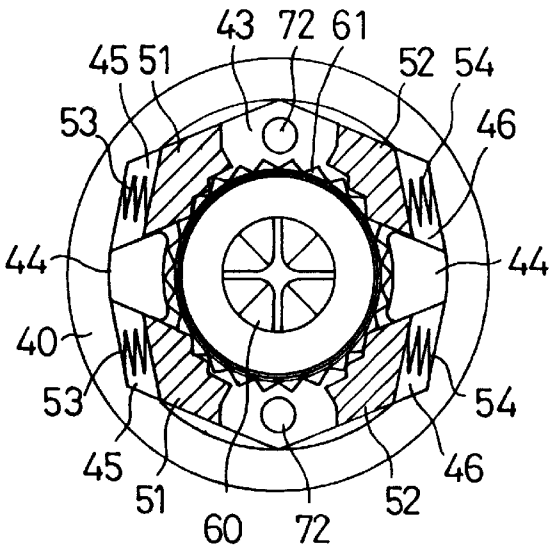
FIG. 3 is a cross sectional view of the ratchet tool.

Referring to the drawings, and initially to FIGS. 1–3, a ratchet tool in accordance with the present invention comprises a housing 40 including an opening 41 and a chamber 43 formed therein (FIG. 1) and communicating with each other, in which the opening 41 is located in the outer portion of the housing 40 for rotatably receiving a cover 70 and the chamber 43 is located in the inner portion of the housing 40 for rotatably receiving a gear 61 of a driving shaft 60. The housing 40 includes three or three pairs of depressions 42 formed in the inner peripheral portion for defining the opening 41 and communicating with the opening 41. The cover 70 includes a bore 78 for rotatably receiving the driving shaft 60 and includes a pair of poles 72 extended inward of the chamber 43. The driving shaft 60 includes an engaging hole 68 for engaging with the fasteners or the tool extensions or the tool bits 88 (FIG. 1).

As shown in FIGS. 1 and 3–5, the housing 40 includes a pair of protrusions 44 oppositely extended inward of the chamber 43 for defining two pairs of parallel channels 45, 46 which are tangent to the gear 61. Two pairs of engaging members, such as pawls 51, 52 are slidably received in the channels 45, 46 respectively and each includes one or more teeth 58 (FIG. 1) for engaging with the gear 61. Two pairs of springs 53, 54 are received in the channels 45, 46 for biasing the pawls 51, 52 to engage with the gear 61. The poles 72 of the cover are extended into the chamber 43 and located between the pairs of pawls 51, 52 for engaging with and for disengaging the pawls 51, 52 from the gear 61 when the cover 70 is rotated relative to the housing 40. The housing 40 includes one or two spring-biased projections 71 engaged therein for engaging with either of the three or three pairs of depressions 42 of the housing 40 and for positioning the cover 70 relative to the housing 40 and for positioning the poles 72 relative to the pawls 51, 52. Alternatively, the projections 71 may be provided in the housing 40 for engaging with either of three or three pairs of depressions formed in the cover 70 and for positioning the cover relative to the housing.

In operation, as shown in FIG. 3, when the cover 70 is not rotated relative to the housing 40 and when the poles 72 are not engaged with the pawls 51, 52, the springs 53, 54 may bias the pawls 51, 52 to engage with the gear 61 such that the gear 61 and thus the driving shaft 60 may be rotated clockwise and counterclockwise by the housing 40. The projections 71 may engage with the middle depressions so as to position the cover 70 relative to the housing 40.

Figure 4:
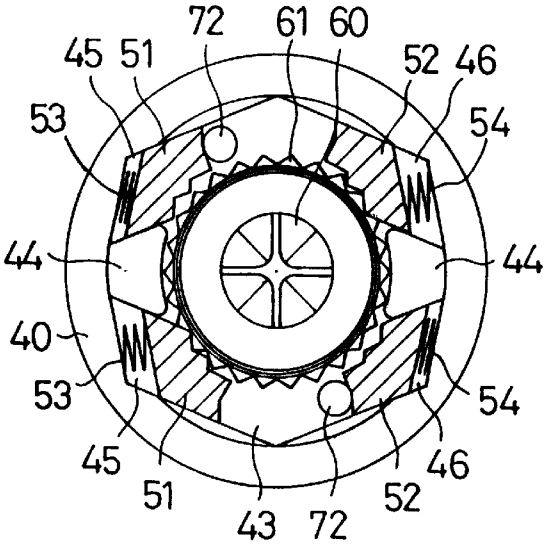

As shown in FIG. 4, when one pair of the two pairs of pawls 51, 52 are moved inward of the channels 45, 46 against the springs 53, 54 by the poles 72, the gear 61 may be driven clockwise by the housing 40 via the pawls 51, 52. At this moment, the projections 71 may engage with a pair of side depressions 42 so as to position the cover 70 relative to the housing 40.

Figure 5:
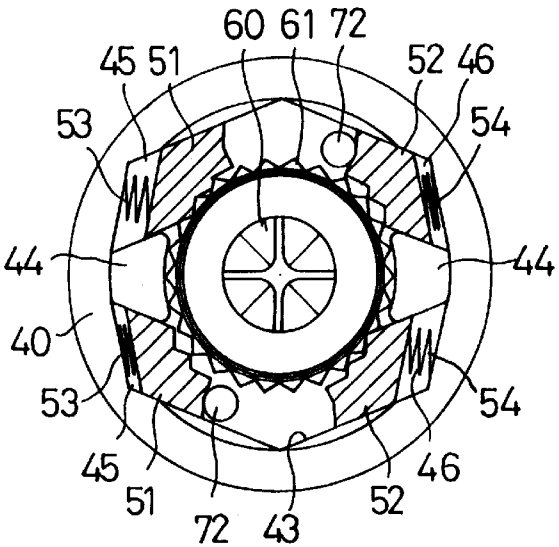
FIGS. 4 and 5 are cross sectional views similar to FIG. 3, illustrating the operation of the ratchet tool.

As shown in FIG. 5, when the other pair of the pawls 51, 52 are moved inward of the channels 45, 46 against the springs 53, 54 by the poles 72, the gear 61 may be driven counterclockwise by the housing 40 via the pawls 51, 52. At this moment, the projections 71 may engage with the other pair of side depressions 42 so as to position the cover 70 relative to the housing 40.

The housing 40 includes a stem 48 extended rearward therefrom for engaging with an engaging orifice 31 of a handle 30 of a screw driver (FIGS. 1, 2) or for engaging with a handle of a wrench and for allowing the handle to drive and to rotate the housing 40. A wrench may also directly engage with the stem 48 for rotating the housing 40. The stem 48 may also includes an engaging hole for engaging with a driving stem of another tool. The housing 40 may also be formed as a driving head that is formed integral on one end of a handle so as to form a ratchet driving mechanism for a tool.

Accordingly, the ratchet tool in accordance with the present invention includes a housing having two pairs of parallel channels tangent to the driving stem for slidably receiving two pairs of pawls and for allowing the pawls to be solidly engaged with the driving stem and for increasing the working life of the ratchet tool.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a housing including a chamber formed therein and including a pair of protrusions oppositely extended inward of said chamber of said housing for defining two pairs of parallel channels, a gear rotatably received in said chamber of said housing and including a driving shaft extended outward of said housing, said pairs of parallel channels being tangent to said gear, two pairs of engaging members slidably engaged in said pairs of parallel channels respectively, means for biasing said engaging members to engage with said gear to allow said housing to drive and to rotate said gear in an active direction, and means for selectively disengaging said engaging members from said gear to allow said housing to be rotated relative to said gear in a reverse direction.

2. A ratchet tool according to claim 1, wherein said pairs of engaging members are pawls.

3. A ratchet tool according to claim 1, wherein said selectively moving means includes a cover rotatably secured to said housing, said cover includes two poles extended into said chamber of said housing and located between said pawls for moving said pawls inward of said channels against said biasing means when said cover is rotated relative to said housing.

4. A ratchet tool according to claim 3 further comprising means for positioning said cover to said housing.

5. A ratchet tool according to claim 4, wherein positioning means includes three depressions formed in said housing, and includes a spring biased projection provided in said cover for engaging with said depressions of said housing and for positioning said cover relative to said housing.

* * * * *